US005799094A

United States Patent [19]

Mouri

[11] Patent Number: 5,799,094

[45] Date of Patent: Aug. 25, 1998

[54] SURROUND SIGNAL PROCESSING APPARATUS AND VIDEO AND AUDIO SIGNAL REPRODUCING APPARATUS

[75] Inventor: Tomohiro Mouri, Musashino, Japan

[73] Assignee: Victor Company of Japan, Ltd., Yokohama, Japan

[21] Appl. No.: 592,728

[22] Filed: Jan. 26, 1996

[30] Foreign Application Priority Data

Jan. 26, 1995 [JP] Japan ..... 7-030140

[51] Int. Cl.[6] ..... H04R 5/00

[52] U.S. Cl. ..... 381/18; 381/1; 381/17

[58] Field of Search ..... 381/1, 17–22, 381/61, 63

[56] References Cited

U.S. PATENT DOCUMENTS

| | | | |
|---|---|---|---|
| 4,159,397 | 6/1979 | Iwahara et al. . | |
| 4,188,504 | 2/1980 | Kasuga et al. . | |
| 5,261,005 | 11/1993 | Masayuki | 381/18 |
| 5,404,406 | 4/1995 | Fuchigami et al. | 381/17 |
| 5,459,790 | 10/1995 | Scofield | 381/18 |
| 5,546,465 | 8/1996 | Kim | 381/63 |
| 5,572,591 | 11/1996 | Numazu et al. | 381/1 |
| 5,579,396 | 11/1996 | Iida | 381/18 |
| 5,604,809 | 2/1997 | Tsubonuma et al. | 381/17 |
| 5,638,451 | 6/1997 | Sedlmeyer | 381/18 |
| 5,666,136 | 9/1997 | Fujishita et al. | 381/1 |

FOREIGN PATENT DOCUMENTS 07046699A 2/1995 Japan .

*Primary Examiner*—Curtis Kuntz
*Assistant Examiner*—Xu Mei
*Attorney, Agent, or Firm*—Jacobson, Price, Holman & Stern, PLLC

[57] ABSTRACT

A surround signal processor reproduces multi-channel audio signals with a pair of left and right rear surround signals via a pair of speakers arranged at front left and right positions roughly symmetrically with respect to a listener. The processor has a sound image localizer with convolvers each of whose filter coefficients Hl and Hr are set based on head transfer functions for each channel of the rear surround signals as follows: $Hl=(SF-AK)/(S^2-A^2)$, where S and A denote transfer functions from each speaker to each listener's ear on the same and the opposite sides of each speaker, respectively; F and K denote transfer functions from positions at which each sound image is required to be localized to each listener's ear on the same and the opposite sides of each speaker, respectively. The localizer adds an output of the filter with filter coefficient Hl for one channel to an output of the other-channel filter with filter coefficient Hr for the other channel and outputs the added outputs as filtered rear left and right surround signals. The left and right rear surround signals passed through the localizer are added to front left and right stereophonic signals to be localized at rear left and right positions roughly symmetrically with respect to the listener, respectively.

8 Claims, 4 Drawing Sheets

SURROUND SIGNAL PROCESSING APPARATUS AND VIDEO AND AUDIO SIGNAL REPRODUCING APPARATUS

BACKGROUND OF THE INVENTION

The present invention relates to surround signal reproduction for reproducing multi-channel audio signals. In particular, the present invention relates to a surround signal processing apparatus and a video and audio signal reproducing apparatus for enabling the multi-channel audio signal reproduction easily through two-channel stereophonic speakers of a household television set, for instance.

As the system of reproducing multi-channel audio signals, there exist a 3-1 system (front left (L) channel, front right (R) channel, center (C) channel, and surround (S) channel) of high vision (high definition TV) and a four-channel matrix system based upon Dolby surround. In particular, many American movies have surround tracks on which audio signals are processed in accordance with the Dolby surround. Further, in a movie theater, audio signals processed by the Dolby surround are demodulated and then reproduced through a plurality of speakers.

Audio signals surround-processed as described above are now on the market as video software. In particular, various Dolby-processed video software or laser disks are now on sale.

However, the above-mentioned systems involve the following problems:

Since the rear sound is of monophonic sound, it is impossible to perfectly represent the motion feeling in the front and rear direction.

Since the Dolby surround is of analog matrix system, it is impossible to perfectly demodulate the audio signals.

Further, the frequency band of the surround channel Sch is limited in a range from 100 to 7 kHz to avert the crosstalk in the front and rear direction.

To overcome these problems, a perfect five-channel system having a discrete rear sound (referred to as AC-3) has been proposed by the Dolby Laboratories Corporation.

In this system, five-channel signals composed of two channel stereophonic signals L and R, one-channel center channel signal C, and two-channel rear surround signals SL and SR are compressed and then transmitted. Therefore, the audio signals can be recorded by use of surround tracks of the conventional package media as they are. In particular, owing to the five-channel discrete system, it is possible to reproduce or achieve an audio field close to that obtained at a theater, as compared with the conventional video software.

On the other hand, a rear one-channel system based upon the conventional Dolby surround has been proposed by the Inventors in Japanese Application Patent No. 6(1994)-197356. In this system, as the rear sound signals, a surround sound image is localized on the rear side of a listener by use of sound image localization technique. Further, these signals are added to the front two-channel stereophonic signals L and R, and then reproduced through the front two-channel speakers. In this case, however, since the rear sound is of monophonic signals, when the left and right side signals are reproduced through the two front speakers, the sound image tends to be formed within the listener's head, with the result that the surround feeling is often damaged. To overcome this problem, it is necessary to form pseudo-stereophonic (two-channel) signals of less interrelation between the left and right side signals, and then to process these signals on the basis of the sound image localization processing.

SUMMARY OF THE INVENTION

With these problems in mind, therefore, it is the object of the present invention to provide a surround signal processing apparatus and a video and audio signal reproducing apparatus which can reproduce all-channel signals through a pair of speakers arranged at two front left and right side positions symmetrically with respect to the listener, so as to cope with the coming discrete five-channel audio signal reproduction stage.

To achieve the above-mentioned object, the present invention provides a surround signal processing apparatus for reproducing multi-channel audio signals including a pair of left and right rear surround signals through a pair of speakers arranged at front left and right positions roughly symmetrically with respect to a listener.

The surround signal processing apparatus comprises: sound image localizing means including convolvers each of whose filter coefficients Hl and Hr are set on the basis of head transfer functions for each channel of a pair of the left and right rear surround signals as follows: $Hl=(S\ F-A\ K)/(S^2-A^2)$ and $Hr=(S\ K-A\ F)/(S^2-A^2)$, where S denotes a transfer function from each of a pair of the speakers to each listener's ear existing on the same side of each speaker; A denotes a transfer function from each of a pair of the speakers to each listener's ear existing on the opposite side of each speaker; F denotes a transfer function from a position at which each sound image is required to be localized to each listener's ear existing on the same side of each speaker; and K denotes a transfer function from a position at which each sound image is required to be localized to each listener's ear existing on the opposite side of each speaker, said sound image localizing means adding an output of the filter whose filter coefficient is set to Hl for one channel to an output of the other-channel filter whose filter coefficient is set to Hr for the other channel, and further outputting a pair of the added outputs as a pair of filtered rear left and right surround signals; and adding means for adding a pair of the left and right rear surround signals passed through said sound image localizing means to a pair of front left and right stereophonic signals, so that the sound images can be localized at a pair of rear left and right positions roughly symmetrically with respect to the listener, respectively.

Further, the surround signal processing apparatus may comprise: sound image localizing means having convolvers each of whose filter coefficients are set on the basis of head transfer functions for each channel of a pair of the left and right rear surround signals, including: a first adder for obtaining addition signals of a pair of the left and right rear surround signals; a second adder for obtaining subtraction signals between a pair of the left and right rear surround signals; a first filter whose filter coefficient P is set to $P=(F+K)/(S+A)$ for processing an output of said first adder; a second filter whose filter coefficient N is set to $N=(F-K)/(S-A)$ for processing an output of said second adder; a third adder for obtaining addition signals of signals filtered by said first and second filters; and a fourth adder for obtaining subtraction signals between signals filtered by said first and second filters, said sound image localizing means outputting outputs of said third and fourth adders, as a pair of filter-processed rear left and right surround signals, respectively; and further adding means for adding a pair of the left and right rear surround signals passed through said sound image localizing means to a pair of front left and right stereophonic signals, so that the sound images can be localized at a pair of rear left and right positions roughly symmetrically with respect to the listener, respectively.

Further, the surround signal processing apparatus may comprise an attenuator for attenuating front center channel signals of the multi-channel audio signals. An output of said attenuator being outputted after having been added to a pair of the front left and right stereophonic output signals, respectively.

Further, the present invention provides a video and audio signal reproducing apparatus having displaying means for reproducing pictures; a pair of speakers arranged on both sides of the displaying means to reproduce audio signals; and the above-mentioned surround signal processing apparatus.

DETAILED DESCRIPTION OF THE PREFERRED EMBODIMENTS

Figure 1:
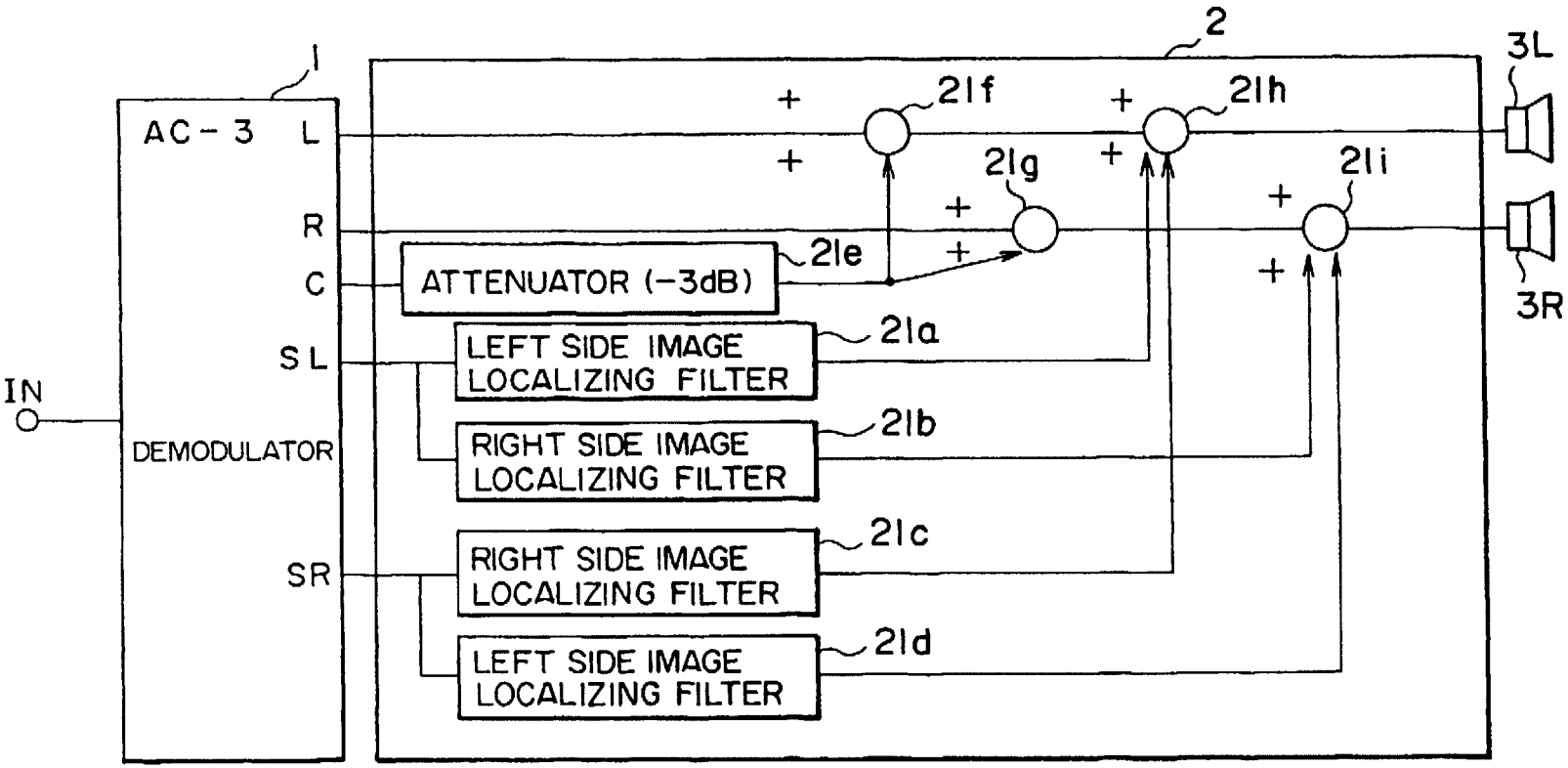
FIG. 1 is a block diagram showing a first embodiment of the surround signal processing apparatus according to the present invention.

FIG. 1 shows a first embodiment of the surround signal processing apparatus according to the present invention. In FIG. 1, a digital signal stream applied to a demodulator 1 (which corresponds to the AC-3 system of the Dolby Laboratories Licensing Corporation) is demodulated separately into five-channel signals (composed of two-channel stereophonic signals L and R, one-channel center signals C, and two-channel rear sound signals SL and SR) and low-frequency band signals less than 100 Hz.

In general, the low-frequency signals are reproduced through one or two super woofers or assigned to the respective channels. In this embodiment, however, the low-frequency signal processing is omitted herein for brevity.

The five-channel signals demodulated and separated by the demodulator 1 are given to a signal processor 2. The rear surround signals SL of the five-channel signals are given to a left side sound image localizing filter 21*a* and a right side sound image localizing filter 21*b* having a pair of convolvers whose coefficients are determined on the basis of the header transfer functions, respectively. Further, the rear surround signals SR of the five-channel signals are given to a right side sound image localizing filter 21*c* and a left side sound image localizing filter 21*d* having a pair of convolvers whose coefficients are determined on the basis of the header transfer functions, respectively.

The center channel signals C are given to an attenuator 21*e* to attenuate the signal level thereof by 3 dB. The level-attenuated center channel signals C are given to two adders 21*f* and 21*g*, respectively. The adder 21*f* adds the inputted center channel signals C to the two-channel stereophonic signals L. The adder 21*g* adds the inputted center channel signals C to the two-channel stereophonic signals R.

The output signals of the adder 21*f* are added to the output signals of the left and right side sound image localizing filters 21*a* and 21*c*, respectively by an adder 21*h*. On the other hand, the output signals of the adder 21*g* are added to the output signals of the left and right side sound image localizing filters 21*d* and 21*b*, respectively by an adder 21*i*.

The output signals of the two adders 21*h* and 21*i* are reproduced through two-channel stereophonic speakers 3L and 3R both arranged at two left and right positions symmetrically with respect to the listener, of a video signal displaying apparatus (not shown) for instance such as a television set TV.

Figure 2:
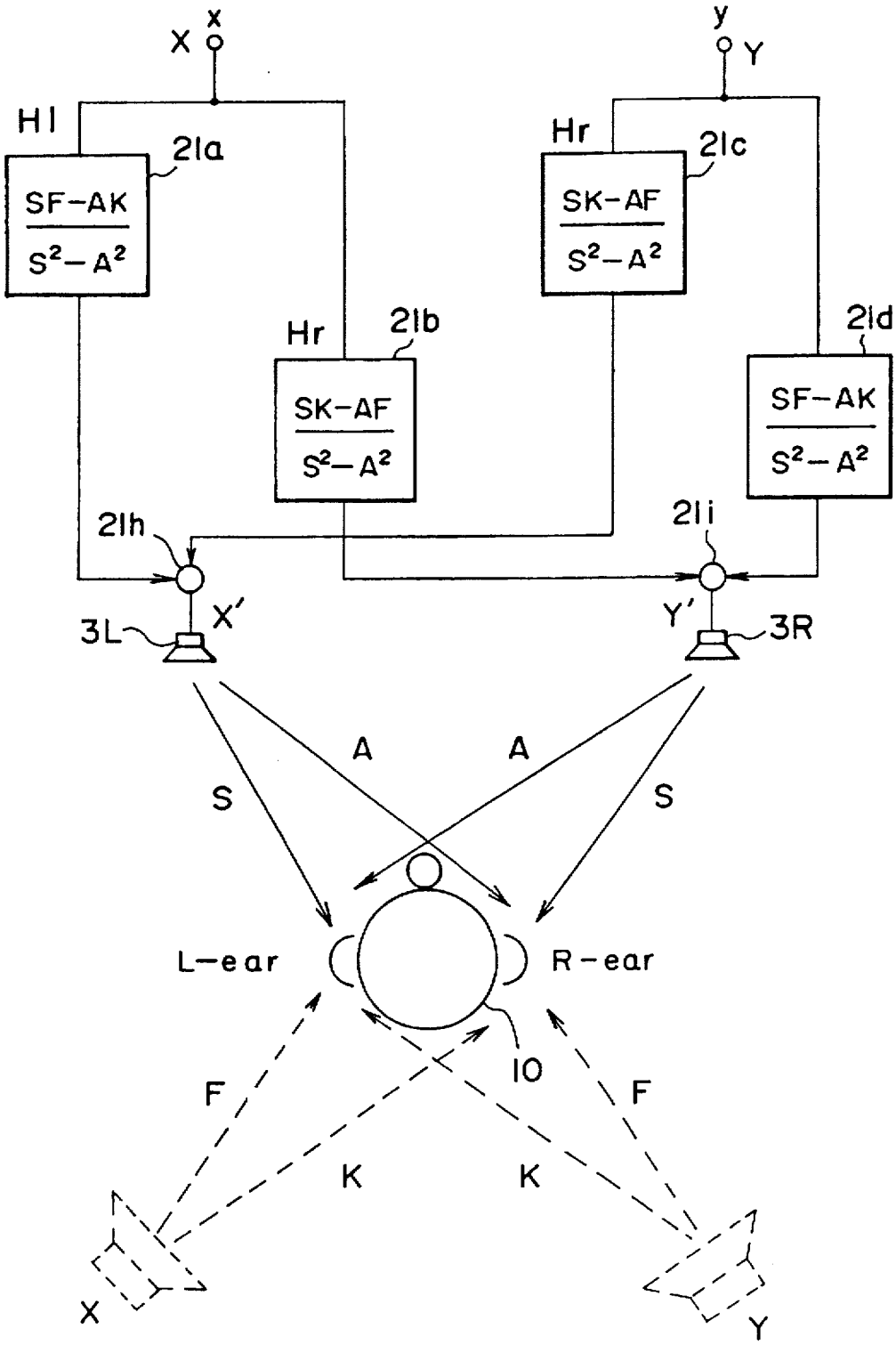
FIG. 2 is a block diagram showing filters (of ATAL-SCHROEDER type filter) used for a sound image localizing circuit for rear surround signals SL and SR shown in FIG. 1.

Here, as a pair of left and right side sound image localizing filters 21*a* and 21*b* or 21*c* and 21*d* provided for each channel of the rear surround signals SL or SR, two filters of ATAL-SCHROEDER type (as shown in FIG. 2) are used to cancel the spacial characteristics from the speakers, respectively. Through these filters, the signals are processed in such a way that the sound images can be localized on the rear left and right sides of the listener, and then added to the output signals of the adders 21*f* and 21*g* (as shown in FIG. 1) by the two adders 21*h* and 21*i*, respectively.

In FIG. 2, S denotes a transfer function from each of a pair of the speakers 3L and 3R to each ear (L-ear or R-ear) of the listener 10 existing on the same side of each speaker 3L or 3R. Further, A denotes a transfer function from each of a pair of the speakers 3L and 3R to each ear (L-ear or R-ear) of the listener 10 existing on the opposite side of each speaker 3L or 3R. Further, F denotes a transfer function from a position at which the sound image is required to be localized to each ear (L-ear or Rear) of the listener 10 existing on the same side of each speaker 3L or 3R. Further, K denotes a transfer function from a position at which the sound image is required to be localized to each ear (L-ear or R-ear) of the listener 10 existing on the opposite side of each speaker 3L or 3R. Here, in FIG. 2, the ear existing on the same or opposite side of each speaker 3L or 3R implies that the ear of the listener 10 existing on the same side of the speaker 3L is the ear L-ear, and the ear of the listener 10 existing on the opposite side of the speaker 3L is the ear R-ear, respectively.

Here, since the two speakers 3L and 3R are arranged on both left and right sides symmetrically with respect to the listener 10, the transfer functions S and A between the respective speakers and the respective listener's ears are both symmetrical with respect to each other. Therefore, when the outputs of the two speakers 3L and 3R arranged symmetrically on the front left and right sides of the listener 10 are denoted by X' and Y', respectively, the two outputs x (L-ear) and y (R-ear) from the two speakers 3L and 3R to both the ears of the listener 10 can be expresses as $$x=SX'+AY'$$

$$y=AX'+SY'$$

Here, since these outputs are required to be equivalent to the input X and Y to the filters, the two inputs X and Y can be expressed as $$X=SX'+AY'$$

$$Y=AX'+SY'$$

Therefore, on the basis of these formulae, the outputs X' and Y' of the two speakers 3L and 3R responsive to the two inputs X and Y to the filters can be expressed as $$X'=(SX-AY)/(S^2-A^2) \quad (1.1)$$

$$Y'=(SY-AX)/(S^2-A^2) \quad (1.2)$$

Here, the sound image localization can be realized by inputting the signals convolved with the transfer functions in the directions required to be localized, to the two inputs X and Y, respectively.

In other words, in FIG. 2, in order to achieve the sound localization as if the two outputs were reproduced from two virtual speakers (as shown by dashed lines) arranged on the rear side of the listener 10, the two outputs X' and Y' of the two speakers 3L and 3R responsive to the two inputs of X=Fx and Y=Kx can be expressed as $$X'=[(SF-AK)/(S^2-A^2)].x=Hl.x \quad (2.1)$$

$$Y'=[(SK-AF)/(S^2-A^2)].x=Hr.x \quad (2.2)$$

Therefore, when two pairs of the sound image localizing filters 21*a* and 21*b*; 21*c* and 21*d* disposed on the left and right sides for each channel of the rear surround signals SL and SR are constructed as four filters each having a filter coefficient Hl or Hr as expressed by the formulae (2.1) and (2.2), it is possible to localize the sound images at two left and right side positions roughly symmetrically with respect to the listener.

Based upon the above-mentioned construction, the two-channel stereophonic signals L and R of the five-channel signals demodulated and separated by the demodulator 1 shown in FIG. 1 are applied to the four adders 21*f*, 21*g*, 21*h* and 21*i* and further reproduced as they are through the two stereophonic speakers 3L and 3R (e.g., of a television set) arranged at front left and right side positions roughly symmetrically with respect to the listener 10. Further, the center channel signals C are attenuated by the attenuator 21*e* by 3 dB in signal level, and then assigned to the two speakers 3L and 3R via the adders 21*f* and 21*g*. Further, the rear surround signals SL and SR are processed through a pair of left and right side sound image localizing filters 21*a* and 21*b*; 21*c* and 21*d* of ATAL-SCHROEDER type (FIR filter) as shown in FIG. 2, respectively so as to be localized on the left and right sides of the listener. After that, the signals passed through these filters 21*a* and 21*b*; 21*c* and 21*d* are added to the two-channel stereophonic signals L and R via the adders 21*h* and 21*i*. Owing to the above-mentioned signal processing, the listener can enjoy a music with presence or realistic feeling as if the listener were enclosed by five-channel sound images while seeing the front side TV set. In particular, since the two rear surround signals SL and SR are different from each other, a high realistic feeing can be obtained.

Figure 3A:
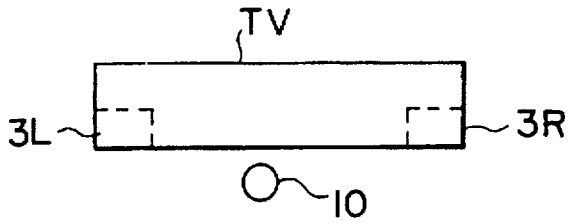
FIG. 3A is an illustration for assistance in explaining the effect of the video and audio signal reproducing apparatus including the first (or second) embodiment of the surround signal processing apparatus according to the present invention.
Figure 3B:
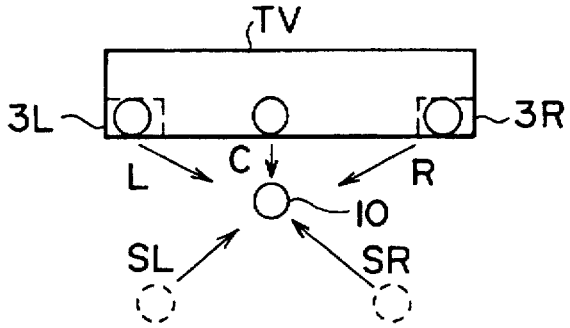
FIG. 3B is an illustration for assistance in explaining the effect of the video and audio signal reproducing apparatus including the first (or second) embodiment of the surround signal processing apparatus according to the present invention.

In other words, when only a pair of speakers 3L and 3R are arranged on both front sides of a television set TV as shown in FIG. 3A, it is possible to reproduce two rear surround signals SL and SR from two rear positions (dashed circles) of the listener, as shown in FIG. 3B. Therefore, a three-dimensional surrounding sound can be reproduced on the basis of the front side stereophonic signals and two rear side stereophonic signals (rear surround) localized on the rear left and right sides, without arranging any rear speakers.

A second embodiment of the surround signal processing apparatus according to the present invention will be described hereinbelow with reference to FIG. 4. This second embodiment is effective in particular when the sound images are localized at two positions just symmetrically with respect to the listener's head. In this case, it is possible to reduce the number (four) of filters used for the first embodiment shown in FIG. 1 down to two filters.

Figure 4:
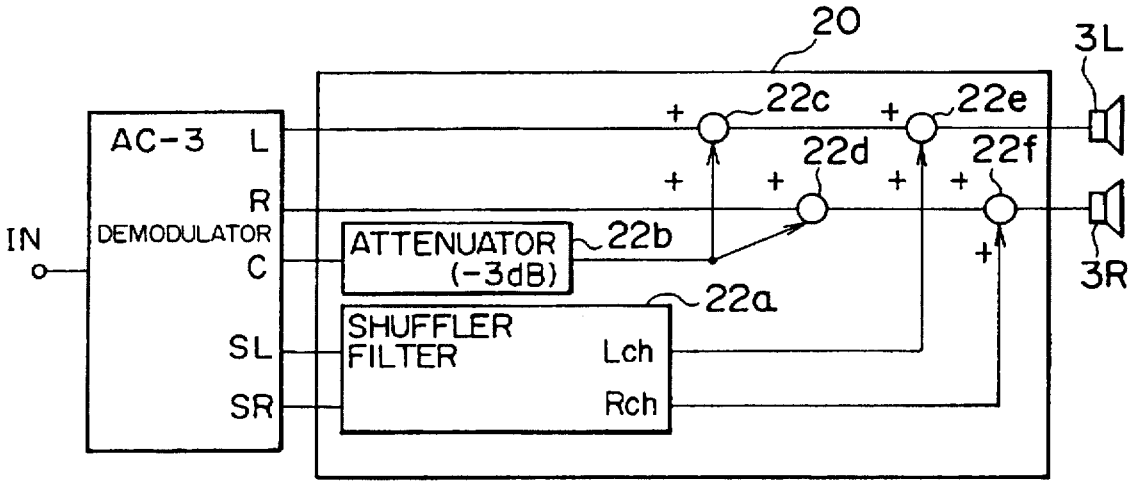
FIG. 4 is a block diagram showing a second embodiment of the surround signal processing apparatus according to the present invention.

In more detail, a signal processor 20 as shown in FIG. 4 is used instead of the signal processor 2 shown in FIG. 1. The signal processor 20 is provided with a sound image localizing circuit 22*a*of shuffler type filter, an attenuator 22*b*, and adders 22*c*, 22*d*, 22*e* and 22*f*.

The sound image localizing circuit 22*a* processes the signals in such a way that two rear surround signals SL and SR can be localized at two rear sides of the listener, and then the processed signals are reproduced through the two-channel stereophonic speakers 3L and 3R arranged on the front left and right sides of the listener. The attenuator 22*b* attenuates the signal level of the center channel signal C by 3 dB. The adders 22*c* and 22*d* add the center channel signals C attenuated through the attenuator 22*b* to the two-channel stereophonic signals L and R, respectively. The adder 22*e* adds the rear surround L-channel signals passed through the sound image localizing circuit 22*a* to the signals L passed through the adder 22*c*. Further, the adder 22*f* adds the rear surround R-channel signals passed through the sound image localizing circuit 22*a* to the signals R passed through the adder 22*d*.

In the above-mentioned construction, as the sound image localizing circuit 22*a*, it is possible to use a shuffler filter as disclosed by the same Inventors in Japanese Patent Application No. 6(1994)-197356.

Figure 5:
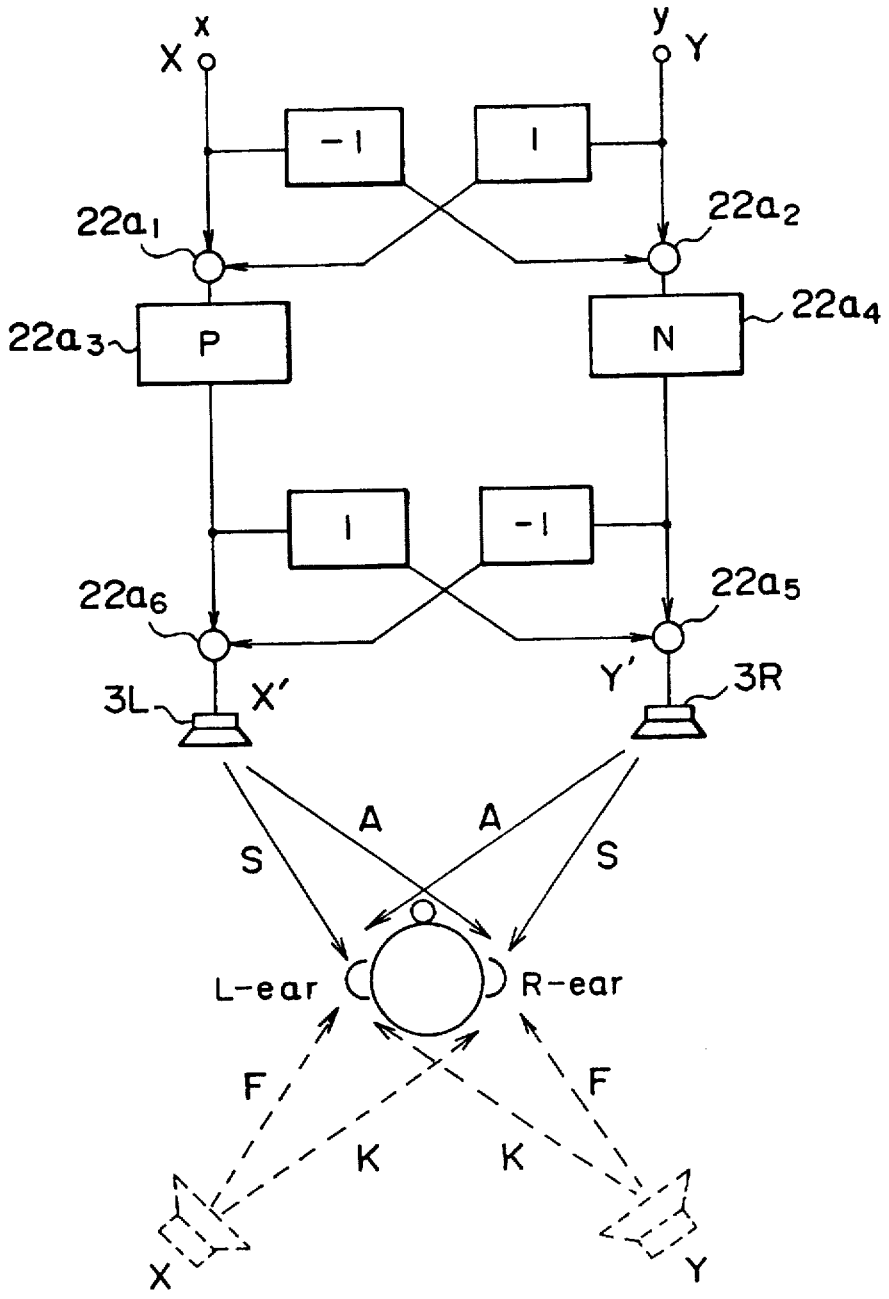
FIG. 5 is a block diagram showing two filters (shuffler filters) used as a sound image localizing circuit for rear surround signals SL and SR shown in FIG. 4.

FIG. 5 shows this shuffler filter. In FIG. 5, a first adder 22*a*1 obtains addition signals of a pair of left and right rear surround signals. Further, a second adder 22*a*2 obtains subtraction signals between a pair of left and right rear surround signals. A first filter 22*a*3 (to which a filter coefficient P as described later is set) processes the output of the first adder 22*a*1. A second filter 22*a*4 (to which a filter coefficient N as described later is set) processes the output of the second adder 22*a*2. A third adder 22*a*5 obtains addition signals of the signals processed through the first and second filters 22*a*3 and 22*a*4. A fourth adder 22*a*6 obtains subtraction signals between the signals processed through the first and second filters 22*a*3 and 22*a*4. Therefore, the third adder 22*a*5 and the fourth adder 22*a*6 output a pair of left and right rear surround signals both processed through the filters 22*a*3 and 22*a*5, respectively.

Here, when the formulae (1.1) and (1.2) are transformed, the following formulae can be obtained as $$X'=[(X-Y)/(S-A)]+Y'$$

$$Y'=[(X+Y)/(S+A)]-X'$$

When these two formulae are solved for X' and Y', the following formulae can be obtained $$X'=N(X-Y)+P(X+Y)$$

$$Y'=P(X+Y)-N(X-Y)$$

Therefore, a shuffler filter can be constructed. The filter coefficients P and N are given by $$P=1/(S+A) \quad (3.1)$$

$$N=1/(S-A) \quad (3.2)$$

Further, the output signals X' and Y' are $$X'=[2(SX-AY)]/(S^2-A^2) \quad (4.1)$$

$$Y'=[2(SY-AX)]/(S^2-A^2) \quad (4.2)$$

which are the same results as those of the formulae (1.1) and (1.2) of the first embodiment. However, since the formulae have a twice value, respectively, the output signals X' and Y' have 6-dB gain, respectively.

Here, when the numerators of the formulae (3.1) and (3.2) are expressed as $$P=(F+K)/(S+A) \quad (5.1)$$

$$S=(F-K)/(S-A) \quad (5.2)$$

the following formulae can be obtained $$X'=[2(SFX+SKY-AFY-AKX)]/(S^2-A^2) \quad (6.1)$$

$$Y'=[2(SFY+SKX-AFX-AKY)]/(S^2-A^2) \quad (6.2)$$

These formulae indicate that when the inputs are X=x and Y=0, the same results as those (2.1) and (2.2) can be obtained.

On the other hand, when the inputs are X=0 and Y=y, $$X'=Hr\cdot y \quad (7.1)$$

$$Y'=Hl\cdot y \quad (7.2)$$

This indicates that when inputted to y, the sound images can be localized at a left or right position symmetrically with respect to the sound image position obtained when inputted to x. Therefore, when the signals are inputted to x and y, respectively, the principle of superposition can be established, so that the two sound images can be localized at the symmetrical left and right positions, respectively.

As described above, in the second embodiment, the shuffler filter is used as the sound image localizing circuit 22a for the two rear surround signals SL and SR, in order to localize the rear surround signals SL and SR on both the left and right sides of the listener. Further, the processed signals are added to the two front two-channel stereophonic signals L and R. Owing to the above-mentioned processing, the listener can enjoy a music as if surrounded by five-channel sound images while seeing a front side TV set, as shown in FIG. 3B. In particular, since the two rear surround signals SL and SR are different from each other, a high realistic feeing can be obtained. In addition, since the number of the filters used can be reduced down to a half of that of the first embodiment shown in FIG. 1, the apparatus construction can be simplified and therefore the circuit cost can be reduced. As a result, the apparatus according to the present invention can be assembled with the household television sets.

In the above-mentioned embodiments, the AC-3 system developed by the Dolby Laboratories Licensing Corporation is used as an example of the five-channel audio signals. Without being limited only thereto, however, the present invention can be applied to any cases where the surround signals are divided into two left and right two-channel signals from the standpoint of signal format.

As described above, the present invention relates to the surround signal processing apparatus and the video and audio signal processing apparatus for reproducing multi-channel audio signals including a pair of rear left and right surround signals, through a pair of the speakers arranged at two front left and right positions roughly symmetrically with respect to a listener or listeners. The apparatus of the present invention is provided with predetermined sound image localizing means having convolvers to which filter coefficients are set on the basis of the head transfer function for each channel of a pair of the left and right rear surround signals. Further, a pair of rear left and right surround signals passed through the sound image localizing means are added to a pair of the front left and right stereophonic signals, in order to localize the sound images thereof at two rear left and right positions roughly symmetrical with respect to the listener, respectively. Therefore, it is possible to obtain a surround reproducing system of a high realistic feeling for the ordinary or household television sets, by reproducing a pair of left and right sound signals through a pair of speakers arranged on the front side of the listener, without need of complicated work such as additional installation of the speakers and additional wiring for the speakers. In addition, there exists another effect that the users can enjoy video software in which five-channel discrete audio processing has been already performed.

What is claimed is:

1. A surround signal processing apparatus for reproducing multi-channel audio signals including a pair of left and right rear surround signals through a pair of speakers arranged at front left and right positions roughly symmetrically with respect to a listener, the apparatus comprising:

sound image localizing means including convolvers each of whose filter coefficients Hl and Hr are set on the basis of head transfer functions for each channel of a pair of the left and right rear surround signals as follows:

$$Hl=(SF-AK)/(S^2-A^2)$$

$$Hr=(SK-AF)/(S^2-A^2)$$

where S denotes a transfer function from each of a pair of the speakers to each listener's ear existing on the same side of each speaker; A denotes a transfer function from each of a pair of the speakers to each listener's ear existing on the opposite side of each speaker; F denotes a transfer function from a position at which each sound image is required to be localized to each listener's ear existing on the same side of each speaker; and K denotes a transfer function from a position at which each sound image is required to be localized to each listener's ear existing on the opposite side of each speaker, said sound image localizing means adding an output of the filter whose filter coefficient is set to Hl for one channel to an output of the other-channel filter whose filter coefficient is set to Hr for the other channel, and further outputting a pair of the added outputs as a pair of filtered rear left and right surround signals; and adding means for adding a pair of the left and right rear surround signals passed through said sound image localizing means to a pair of front left and right stereo-phonic signals, so that the sound images can be localized at a pair of rear left and right positions roughly symmetrically with respect to the listener, respectively.

2. The surround signal processing apparatus of claim 1, further comprising an attenuator for attenuating front center channel signals of the multi-channel audio signals, an output of said attenuator being outputted after having been added to a pair of the front left and right stereo-phonic signals, respectively.

3. A surround signal processing apparatus for reproducing multi-channel audio signals including a pair of left and right rear surround signals through a pair of speakers arranged at front left and right positions roughly symmetrically with respect to a listener, the apparatus comprising:

sound image localizing means having convolvers each of whose filter coefficients are set on the basis of head transfer functions for each channel of a pair of the left and right rear surround signals, including:

a first adder for obtaining addition signals of a pair of the left and right rear surround signals;

a second adder for obtaining subtraction signals between a pair of the left and right rear surround signals;

a first filter whose filter coefficient P is set to P=(F+K)/(S+A) for processing an output of said first adder;

a second filter whose filter coefficient N is set to N=(F−K)/(S−A) for processing an output of said second adder, where S denotes a transfer function from each of a pair of the speakers to each listener's ear existing on the same side of each speaker; A denotes a transfer function from each of a pair of the speakers to each listener's ear existing on the opposite side of each speaker; F denotes a transfer function from a position at which each sound image is required to be localized to each listener's ear existing on the same side of each speaker; and K denotes a transfer function from a position at which each sound image is required to be localized to each listener's ear existing on the opposite side of each speaker;

a third adder for obtaining addition signals of signals filtered by said first and second filters; and a fourth adder for obtaining subtraction signals between signals filtered by said first and second filters, said sound image localizing means outputting outputs of said third and fourth adders, as a pair of filter-processed rear left and right surround signals, respectively; and adding means for adding a pair of the left and right rear surround signals passed through said sound image localizing means to a pair of front left and right stereo-phonic signals, so that the sound images can be localized at a pair of rear left and right positions roughly symmetrically with respect to the listener, respectively.

4. The surround signal processing apparatus of claim 3, further comprising an attenuator for attenuating front center channel signals of the multi-channel audio signals, an output of said attenuator being outputted after having been added to a pair of the front left and right stereo-phonic signals, respectively.

5. A video and audio signal reproducing apparatus having displaying means for reproducing pictures; a pair of speakers arranged on both sides of the displaying means to reproduce audio signals; and a surround signal processing apparatus for processing a pair of rear left and right surround signals of multi-channel audio signals to reproduce the processed signals through a pair of the speakers, respectively, wherein:

the surround signal processing apparatus comprises sound image localizing means including convolvers having a pair of sound image localizing filters each of whose filter coefficients Hl and Hr are set on the basis of head transfer functions for each channel of a pair of rear left and right surround signals as follows:

$$Hl=(SF-AK)/(S^2-A^2)$$

$$Hr=(SK-AF)/(S^2-A^2)$$

where S denotes a transfer function from each of a pair of the speakers to each listener's ear existing on the same side of each speaker; A denotes a transfer function from each of a pair of the speakers to each listener's ear existing on the opposite side of each speaker; F denotes a transfer function from a position at which each sound image is required to be localized to each listener's ear existing on the same side of each speaker; and K denotes a transfer function from a position at which each sound image is required to be localized to each listener's ear existing on the opposite side of each speaker; and said sound image localizing means adds an output of the filter whose filter coefficient is set to Hl for one channel and an output of other-channel filter whose filter coefficient is set to Hr for the other channel, and further outputs a pair of the added outputs, as a pair of filtered rear left and right surround signals respectively, wherein the pair of the left and right rear surround signals passed through said sound image localizing means are added to a pair of front left and right stereophonic signals, to localize sound images at a pair of rear left and right positions roughly symmetrically with respect to a listener, respectively.

6. A video and audio signal reproducing apparatus having displaying means for reproducing pictures; a pair of speakers arranged on both sides of the displaying means to reproduce audio signals; and a surround signal processing apparatus for processing a pair of rear left and right surround signals of multi-channel audio signals to reproduce the processed signals through a pair of the speakers, respectively, wherein:

the surround signal processing apparatus comprises sound image localizing means including convolvers each of whose filter coefficients are set on'the basis of head transfer functions for each channel of a pair of rear left and right surround signals and including:

a first adder for obtaining addition signals of a pair of the left and right rear surround signals;

a second adder for obtaining subtraction signals between a pair of the left and right rear surround signals;

a first filter whose filter coefficient P is set to P=(F+K)/(S+A) for processing an output of said first adder;

a second filter whose filter coefficient N is set to N=(F−K)/(S−A) for processing an output of said second adder, where S denotes a transfer function from each of a pair of the speakers to each listener's ear existing on the same side of each speaker; A denotes a transfer function from each of a pair of the speakers to each listener's ear existing on the opposite side of each speaker; F denotes a transfer function from a position at which each sound image is required to be localized to each listener's ear existing on the same side of each speaker; and K denotes a transfer function from a position at which each sound image is required to be localized to each listener's ear existing on the opposite side of each speaker;

a third adder for obtaining addition signals of signals filtered by said first and second filters; and a fourth adder for obtaining subtraction signals between signals filtered by said first and second filters; and said sound image localizing means outputs outputs of said third and fourth adders, as a pair of filter-processed rear left and right surround signals, respectively, wherein the pair of filter-processed rear left and right surround signals passed through said sound image localizing means are added to a pair of front left and right stereophonic signals, to localize sound images at a pair of rear left and right positions roughly symmetrically with respect to a listener, respectively.

7. The surround signal processing apparatus of claim 6, further comprising an attenuator for attenuating front center channel signals of the multi-channel audio signals, an output of said attenuator being outputted after having been added to a pair of the front left and right stereo-phonic signals, respectively.

8. The surround signal processing apparatus of claim 5, further comprising an attenuator for attenuating front center channel signals of the multi-channel audio signals, an output of said attenuator being outputted after having been added to a pair of the front left and right stereophonic signals, respectively.

* * * * *